US008104243B2

(12) United States Patent
Takeshima et al.

(10) Patent No.: US 8,104,243 B2
(45) Date of Patent: Jan. 31, 2012

(54) PROJECTED CORNER COLUMN AND DEVICE FOR APPLYING CHAMFERING WORK TO THE COLUMN

(75) Inventors: Hiroshi Takeshima, Ogaki (JP); Nobuyuki Kobayashi, Inaba-gun (JP); Hiroshi Tonomura, Chita-gun (JP)

(73) Assignee: Nichiha Corporation, Nagoya-shi (JP)

( * ) Notice: Subject to any disclaimer, the term of this patent is extended or adjusted under 35 U.S.C. 154(b) by 915 days.

(21) Appl. No.: 11/793,601

(22) PCT Filed: Sep. 27, 2005

(86) PCT No.: PCT/JP2005/017707

§ 371 (c)(1),
(2), (4) Date: Apr. 29, 2008

(87) PCT Pub. No.: WO2006/070517

PCT Pub. Date: Jul. 6, 2006

(65) Prior Publication Data

US 2009/0100795 A1 Apr. 23, 2009

(30) Foreign Application Priority Data

Dec. 28, 2004 (JP) ..... 2004-380921

(51) Int. Cl.
*E04B 2/00* (2006.01)

(52) U.S. Cl. ..... 52/287.1; 52/255; 52/846

(58) Field of Classification Search ..... 52/287.1, 52/288.1, 255, 846, 847, 850, 851, 856
See application file for complete search history.

(56) References Cited

U.S. PATENT DOCUMENTS 669,148 A * 3/1901 Smith ..... 52/276
4,863,774 A * 9/1989 Tucker ..... 428/77
5,103,612 A * 4/1992 Wright ..... 52/288.1

FOREIGN PATENT DOCUMENTS

JP 51-84221 7/1976
JP 52-101828 8/1977

(Continued)

OTHER PUBLICATIONS

Written Opinion of the International Searching Authority dated Jan. 10, 2006 (5 Sheets.).

*Primary Examiner* — Brian Glessner
*Assistant Examiner* — Adam Barlow
(74) *Attorney, Agent, or Firm* — Edwards Wildman Palmer LLP

(57) ABSTRACT

The present invention provides a projected corner column A1 used for an external corner part of a wall of a building, in which a narrow chamfered part 8 is formed on an apex corner 3 of the projected corner column A1, the narrow chamfered part 8 has a continuous curved surfaces 8*a*, 8*b* rather than a flat surface so that, when the projected corner column A1 is exposed to a daytime sunlight, light parts and shade parts similar to light parts S and shade parts D that generate on surface patterned parts of a board piece 1*a* generate on the chamfered part 8, whereby the chamfered part 8 on the apex corner 3 of the projected corner column A1 becomes less visible as far as possible, and shades similar to the shades (S, D) that generate on the surface patterned parts generate on the chamfered part 8 to give a continuity to the patterns on the left and right board pieces 1*a*, 1*a*.

17 Claims, 11 Drawing Sheets

FOREIGN PATENT DOCUMENTS

| | | | | |
|---|---|---|---|---|
| JP | 61-249264 | | | 11/1986 |
| JP | 6-299677 | | | 10/1994 |
| JP | 9-189082 | | | 7/1997 |
| JP | 11-188294 | | | 7/1999 |
| JP | 2000-240258 | | | 9/2000 |
| JP | 2000240258 | A | * | 9/2000 |
| JP | 2003-262031 | | | 9/2003 |
| JP | 2004-316298 | | | 11/2004 |
| JP | 2004316298 | A | * | 11/2004 |
| JP | 2005016182 | A | * | 1/2005 |
| JP | 2005-282094 | | | 10/2005 |
| JP | 2005-336919 | | | 12/2005 |
| JP | 2006-183425 | | | 7/2006 |

* cited by examiner (a)

(b)

(a)

(b)

PROJECTED CORNER COLUMN AND DEVICE FOR APPLYING CHAMFERING WORK TO THE COLUMN

BACKGROUND OF THE INVENTION

1. Field of the Invention

The present invention relates to an external corner (arris) pole used as an exterior material of an external corner of a wall of a building, and an apparatus for chamfering the apex corner thereof.

2. Description of the Prior Art

Generally, as an exterior material of an external corner of a wall of a building, a projected corner column A as shown in FIG. 15 has been known (see JP 11-188294 A). For the production of the projected corner column A, usually a ceramic building board 1 having surface patterned parts (not shown) is used and the building board 1 is cut to have an appropriate width to give board pieces 1*a*, 1*a*, a lateral side of each board piece is cut at an angle (in many cases, at 45 degrees although not restricted thereto) (FIG. 16*b*), and cut surfaces 2, 2 are bonded with each other so that the surface pattern phases of the board pieces accord with each other at an apex corner 3 to give a body having an approximately L shaped cross-section (FIG. 16*c*).

During the bonding, misalignment may occur at the apex corner 3 or an adhesive may protrude off from the apex corner. In order to remove such problems, the apex corner 3 is subjected to chamfering 4 by a mechanical means such as a tenoner cutting machine (FIG. 16*d*). If the amount of an adhesive applied is too small, protrusion of an adhesive can be prevented. However, in this case, voids without an adhesive are liable to produce at the bonded part, which necessitates filling the voids by putty treatment or chamfering up to the part where the adhesive is embedded.

In either case, according to a conventional chamfering, a cut-processed surface 4 becomes a flat surface having a width as broad as about 10 mm to 20 mm as shown in FIGS. 15 and 16*d* and the chamfered part (cut-processed surface 4) has a color different from that of the surface of the board piece 1*a*, whereby coating is separately effected by using an apparatus such as that described in Patent Document 1.

As mentioned above, in a conventional projected corner column, an apex corner thereof has been subjected to chamfering over broad width using an apparatus such as tenoner cutting machine. Since a chamfered part is a wide flat surface having a width of approximately 10 mm to 20 mm, the part is highly visible even if it is coated. And since the chamfered part has a flat surface, the shade that generates on the part inevitably becomes different from that on a surface concavo-convex patterned part 5.

A projected corner column A is sometimes formed by bonding board pieces 1*a*, 1*a* each having, as a surface patterned part, an embossed pattern consisting of a plurality of convex stripes 6 and a plurality of concave grooves 7 both extending in a direction that intersects with a bonded surface as shown in FIGS. 17 and 18. In this case, a distance a between the tops of adjacent convex stripes 6, 6 is not more than about 30 mm on average, and is about 5 to 20 mm in many cases. Even in this form of projected corner column A, protrusion of adhesives Pa, Pb occurs in the vicinity of the top of convex stripe 6 and in the vicinity of the bottom of concave groove 7 as shown by a cross-section in the direction of the axis line of the bonded part in FIG. 18. In order to remove the adhesive Pa irregularly protruding in the vicinity of the top of the convex stripe 6, the apex corner 3 is subjected to chamfering with a mechanical means such as a tenoner cutting machine also in this case. Usually a chamfered part 8 having a rhombic flat surface is formed on the top of each convex stripe 6 as shown in FIG. 17 although the shape somewhat varies depending on the shape of the cross-section of the convex stripe 6.

When such projected corner column is installed as a corner material of an exterior material and exposed to a daytime sunlight, one side of the convex stripe 6 formed on each of the right and left board pieces 1*a*, 1*a* generates a light part S and the other side generates a shade part D to exhibit stereoscopic effect. Since a chamfered part 8 that is a rhombic flat surface as described above exists at the apex corner 3, the part gives a large light region Sa. The region Sa is not only highly visible and gives an odd sensation, but also breaks the continuity of the shade parts D of the convex stripes 6 on the right and left board pieces, thereby continuity of the pattern is lost. Due to such discontinuity, natural appearance is also lost.

Furthermore, an adhesive Pb protruded to the bottom of the concave groove 7 cannot be removed by chamfering with a mechanical means such as a tenoner cutting machine, and thus must be removed manually. However, in the case of a projected corner column that was produced by bonding board pieces 1*a*, 1*a* each having an embossed pattern consisting of a plurality of convex stripes 6 and a plurality of concave grooves 7 both extending in a direction that intersects with a bonded surface as shown in FIG. 17, the number of concave grooves 7 is necessarily large, and thus labors for removing the adhesive Pb are largely increased.

SUMMARY OF THE INVENTION

The present invention was made to solve the above-described problems involved in the conventional projected corner columns, and is intended to provide a projected corner column which is produced by bonding board pieces each having, as a surface pattern, a concavo-convex pattern such as an embossed pattern extending in a direction that intersects with a bonded surface in such a way as to give an apex corner, in which a chamfered part formed at the apex corner is less visible, and a shade approximately similar to that generated in the surface pattern generates in the chamfered part so that the chamfered part does not cause an odd sensation, as well as to provide an apparatus for chamfering the apex corner of the projected corner column.

A projected corner column according to the present invention is formed by bonding at least two board pieces in such a way that one of the edges of one board piece is bonded to that of the other board piece to form an apex corner, and is characterized in that a chamfered part with a narrow width is formed at the apex corner, and said chamfered part has a concavo-convex surface having irregular convexoconcaves (concavity and convexity) rather than a flat surface.

In the present invention, it is preferable to use, as a board piece that constitutes a projected corner column, a board piece with an appropriate width cut out from a conventional ceramic building board although not restricted thereto. In a projected corner column according to the present invention, a chamfered part formed at the apex corner has a narrow width and has a convexo-concave surface. Therefore, it is possible to decrease an odd sensation due to a difference in color by applying a required coating that resembles the surface pattern of the board piece to the chamfered part. In addition, if a board piece has a surface convexo-concave pattern, it is possible to produce in the chamfered part a shade similar to that generated in the board piece because the chamfered part has a convexo-concave surface. Accordingly, the chamfered part becomes less visible.

It is preferable to use, as a board piece which constitutes a projected corner column, a board piece in which grooves and convex regions defined by said grooves are formed and a surface convexo-concave pattern is formed on the convex regions. By using such board piece, a projected corner column well-matched with the convexo-concave surface of the chamfered part and having a high quality in design can be obtained. In addition, as a board piece which constitutes a projected corner column, a board piece that has, on its surface, grooves extending in a direction that intersects with the apex corner is used, and a bonding surface between a concave part formed on the apex corner of the projected corner column and corresponding to said grooves and the chamfered part formed on the apex corner is made to form a curved surface. In this constitution, continuity between the groove and convex region on the surface of the board piece and the chamfered part on the apex corner is further ensured and a quality in design is increased.

Incidentally, the term "convexo-concave surface on the chamfered part" in this invention refers to a convexo-concave surface that has irregular convexity and concavity that can be confirmed by touching with a tip of a finger but not to a convexo-concave surface that has convexes and concaves in a microscopic meaning, and specifically, refers to a surface having irregular convexity and concavity with a depth or height of approximately 0.3 to 5 mm from the bottom part. In the case where a board piece which is a material of a projected corner column has the above-mentioned convex regions and said convex region has a surface concavo-convex pattern, it refer to a concavo-convex surface having convexoconcaves that are approximately the same as the convexoconcaves (usually, having a depth or height of 0.3 to 5 mm) formed on the surface concavo-convex patterned part.

In addition, in the present invention, a board piece that constitutes a projected corner column has, as a surface pattern, an embossed pattern extending in a direction that intersects with the bonded surface. More specifically, the embossed pattern is a pattern formed by plural convex stripes and plural concave grooves both extending in a direction perpendicular to the bonded surface and aligned alternately, wherein the shape each of convex stripe and concave groove may be the same, or a convex stripe or concave groove of different shape may be included. The latter is preferable in view of design in external appearance. The above embossed pattern may be formed on the whole surface or the other pattern may be partly included.

There is no limitation on the height from the lowest groove part up to the highest convex part of an embossed pattern extending in a direction that intersects with the bonded surface, namely there is no limitation on the distance between the bottom of a concave groove and the top of a convex stripe, although it is practically not more than about 15 mm in view of a practical thickness and a design in external appearance of a board piece. In addition, it is preferable that the distance between the adjacent tops of an embossed pattern extending in a direction that intersects with the bonded surface, namely the distance between the tops of adjacent convex stripes, is not more than 30 mm, and more preferably about 5 to 20 mm in view of ensuring a continuity of the patterns in a chamfered part. Depending on a pattern, however, the distance a between the tops may be about 100 mm in some cases (see FIG. 11).

In a projected corner column of the present invention, board pieces are bonded in such a way that the convexoconcave of an embossed pattern on each board piece fits with each other at an apex corner. And on the apex corner is formed a narrow chamfered part, and the chamfered part is made to form a continuous curved surface at least in the convex region of the embossed pattern at the apex corner. By making the chamfered part form such a continuous curved surface, it is possible to produce in the chamfered part a shade approximately the same as the shade that generates on an embossed pattern that constitutes a surface patterned part when a light is irradiated in a oblique direction. Owing to such shade, a viewer can feel that the embossed patterns on right and left board pieces are continuous, and in combination with the narrow width of the chamfered part, the chamfered becomes less visible and thus the resulting projected corner column gives a high-grade sensation not having an odd sensation.

Namely, the projected corner column according to the present invention is a projected corner column which is formed by bonding at least two board pieces in such a way that one of the edges of one board piece contacts that of the other board piece to form an apex corner, and is characterized in that each of said board pieces has, as a surface patterned part, an embossed pattern extending in a direction that intersects with the bonded surface, a chamfered part with a narrow width is formed on the apex corner, and said narrow chamfered part is made to generate a light part and a shade part similar to a light part and a shade part that generate in the surface patterned parts of the board pieces when the projected corner column is exposed to a light.

In a projected corner column according to the present invention, a plain view shape of a part of the narrow chamfered part corresponding to the convex region of an embossed pattern may be the same or may be different at least between adjacent parts. The "plain view shape" herein refers to a shape visually confirmed when the projected corner column is placed on a plain surface with an apex corner turning up and a chamfered part formed on the apex corner is looked down along a line that divides the apex corner into two parts. At a part where the shapes of convex regions of an embossed pattern are the same in the vicinity of the apex corner, the plain view shape of a narrow chamfered part is substantially the same, whereas convex regions having different shapes give different plain view shapes. Even a part having the same shape of convex regions can give different plain view shape by varying the amount of cutting in chamfering. In either case, it is possible to produce a projected corner column high in natural appearance and excellent in design in external appearance by providing a chamfered part of a projected corner column with chamfered regions having different plain view shapes.

In addition, in a case where the shapes of convex regions in embossed patterns formed on right and left board pieces are different from each other in the vicinity of an apex corner, there is obtained a chamfered part having different plain view shapes at the left side and the right side of a bonded surface of two board pieces. Also in this case, a projected corner column having a high natural appearance and excellent in design in external appearance can be obtained.

As described above, a plain view shape of a chamfered part varies mainly depending on the shapes in the vicinity of an apex corner of convex regions in embossed patterns formed on right and left board pieces. When the plain view shape of a chamfered part is circular, trapezoidal, triangular, rectangular or the like, or their combinations, a projected corner column having a high natural appearance and excellent in design in external appearance can also be obtained.

Incidentally, in a projected corner column of the present invention, the maximum width of a narrow chamfered part is preferably not more than 8 mm, more preferably 2 to 5 mm, even more preferably 2 to 3 mm in view of dripping during coating and chipping off during processing. By decreasing the width, continuity between left and right embossed patterns can be further enhanced.

In a preferred embodiment of a projected corner column of the present invention, an adhesive to be used for bonding board pieces is characterized in that it is a moisture-curable adhesive. As a moisture-curable adhesive, a moisture-curable urethane resin adhesive is particularly preferred. When a board piece which constitutes a projected corner column is a ceramic building board incorporated with small wood flake chips, not only moisture in the atmosphere but also the hydroxyl groups contained in the chips contribute to the polymerization and curing of an adhesive, and thus use of a moisture-curable urethane resin adhesive is particularly preferred.

As a more preferred embodiment, it is desirable to supply water in a form of mist to a cross-section of a board piece or to an apex corner and the vicinity thereof prior to curing of an adhesive. The water in the form of mist is liable to penetrate into the inside of the board pieces through the cross-sections of the board pieces, and curing of a moisture-curable urethane resin adhesive is accelerated by the moisture penetrated into the inside and the adhesive rapidly expands, whereby the adhesive gets into the inside of the board piece and cures, and as a result, firm adhesion bonding of the board pieces proceeds.

Moreover, if water is applied in a form of mist after application of a moisture-curable urethane resin adhesive, polymerization and curing of the adhesive proceed at an early stage due to the hydroxyl groups present in the water applied, and dripping off of the adhesive is prevented to bring about the effect of inhibiting deterioration in external appearance, while an uncured adhesive may run off from an apex corner during bonding of board pieces and the uncured adhesive may flow out along the surface of a projected corner column when water is not applied. It is desirable to utilize microwave heating for curing the adhesive.

A projected corner column of the present invention is characterized in that a coat is formed on a chamfered part having convexoconcaves by post-coating along the irregular convexoconcaves.

In the projected corner column of the present invention, preferably a coat having a pattern similar to that in the surface patterned part of a board piece is formed on a chamfered part so that, when the external corner pole is exposed to a light in an oblique direction, a shade approximately the same as a shade that generates on an embossed pattern constituting a surface patterned part can generate on the chamfered part. Combined with narrow width of the chamfered part, a viewer can feel that the embossed patterns on left and right board pieces are continuous, the chamfered part becomes less visible, and the projected corner column gives a high-grade sensation.

The post-coating applied on the chamfered part of the projected corner column of the present invention may follow the width of irregular convexoconcaves formed on the chamfered part, or may exceed the boundary between the chamfered part and the board piece and slightly reach the embossed pattern. Either coat can be formed by using a means to adjust the amount of a paint adhered to a coating roller which moves along the convexoconcaves formed by chamfering on the apex corner as described below, or the like. An embodiment of the projected corner column of the present invention is characterized in that the lower edge of a coat formed by post-coating is approximately linear when the projected corner column is seen sideways. The projected corner column of this embodiment can also be produced by adjusting the amount of a paint adhered to a coating roller.

The coat formed by post-coating preferably consists of at least two coating layers, and more preferably consists of plural layers comprising a sealer layer, an undercoat, an intermediate coat and a top coat and has a pattern similar to the surface pattern of a board piece constituting a projected corner column. By such coat, a joint line between two board pieces becomes natural and a projected corner column in which the durability at this part is enhanced can be obtained.

Incidentally, in a projected corner column of the present invention, a side (end surface of lumber) opposite to the side which forms an apex corner of board pieces may be a vertical cut surface or a chamfered part may be formed on the surface edge of the end surface of lumber. By chamfering the end surface of lumber, continuity in appearance with a ceramic building board of a building body can be ensured.

Furthermore, the present invention discloses an apparatus for chamfering an apex corner of a projected corner column formed by mutually bonding longitudinal sides of at least two board pieces to give the apex corner, characterized in that said apparatus at least comprises a projected corner column-supporting means that supports the projected corner column horizontally with keeping at least the apex corner in an exposed state, a chamfering means equipped with a cutting part that abuts against the apex corner of the projected corner column supported by the projected corner column-supporting means and chamfers the apex corner, a chamfering means-supporting means that supports the chamfering means movably up and down relative to a fixed machine casing via an elastic body, and a displacement means that gives a relative displacement between the projected corner column-supporting means and the chamfering means. The cutting part of the chamfering means may be optional but an air grinder is particularly effective.

By using the above-described apparatus, a projected corner column of the present invention can be readily produced. In the production, initially a projected corner column formed by mutually bonding longitudinal sides of at least two board pieces to give an apex corner is prepared similarly as in a conventional method. The projected corner column thus prepared is attached to a projected corner column-supporting means with exposing the apex corner, for example, upward.

The cutting part of the chamfering means is engaged with the apex corner of the projected corner column supported by the projected corner column-supporting means and a relative displacement between the projected corner column-supporting means and the chamfering means is given. Preferably, the chamfering means is fixed and the projected corner column-supporting means is displaced so that the whole edge part of the apex corner of the projected corner column passes through the cutting part of the chamfering means. The chamfering means may be displaced and the projected corner column-supporting means may be fixed, or alternatively, the both may be displaced in an opposite direction. The both may be displaced in the same direction at different speeds.

The apparatus of the present invention is provided with a chamfering means-supporting means that supports the chamfering means movably up and down relative to a fixed machine casing via an elastic body. Its own whole weight being supported by the elastic body, the chamfering means is maintained in a floated state and moves up and down relative to the machine casing in compliance with the contact manner between the cutting part and the apex corner of the projected corner column. By selecting own weight of a chamfering means and the length and rate of spring of the elastic body, it is possible to appropriately set out the positioning in a vertical direction of the cutting part relative to the apex corner of a projected corner column to be chamfered in a contact-free state, as well as a load that the apex corner of the projected corner column imparts to the cutting part or vice versa and a variance of the load when they are in contact with each other.

The cutting part is set up at a position lower than that of the apex corner of the projected corner column by a certain distance in a contact-free state. In this state, the cutting part is raised and, after the projected corner column-supporting means is displaced to place the projected corner column below the cutting part, the cutting part and the apex corner of the projected corner column are brought to a contact state. In this state, the projected corner column is displaced in the edge line direction of the apex corner (as described above, the projected corner column may be fixed and the chamfering means may be displaced). By this displacement, the cutting part cuts (chamfers) the edge part of the apex corner with moving up and down and tracing the convexoconcaves produced on the apex corner, whereby a concavo-convex surface having such a shape as if the convexoconcaves that the apex corner initially had are traced is formed on the edge part of the projected corner column after chamfering.

By appropriately setting up the rate of spring of the elastic body in compliance with the hardness of the apex corner of a projected corner column to be chamfered or optionally the shape of the protruded and solidified adhesive, a cutting depth or a degree of concavity and convexity can be appropriately adjusted. Since a cutting depth and a degree of flatness of a cut surface vary depending on the difference in relative speeds of a projected corner column and the cutting part, as well as a number of revolutions of a rotating grinder when it is used as a cutting tool, an elastic body having an optimum rate of spring is selected experimentally or by calculation in compliance with the width and degree of concavity and convexity of an aimed chamfered part.

When plural projected corner columns are chamfered successively at a constant setting and a projected corner column having too large misalignment of the board pieces at the apex corner is included because of convenience in the production of projected corner columns, they may occur a case where only a protruded portion of the ridge part of such projected corner column is cut and chamfering terminates. As a measure against such case, a fixed cutting tool may be provided upstream the cutting part in a feeding direction of a projected corner column to cut and remove an edge portion which protrudes beyond a specified value, if there is a protrusion.

According to the present invention, it is possible to obtain a projected corner column in which a chamfered part is made to be less visible as far as possible and is made to generate, on a chamfered part, a shade similar to the shade that will generate on the surface concavo-convex patterned part, and thus does not cause an odd sensation. In addition, by providing the chamfered part with a concavo-convex surface having irregular concavity and convexity, the chamfered part does not cause an odd sensation even if it includes a somewhat broad part.

BRIEF EXPLANATION ON THE DRAWINGS

Figure 5:
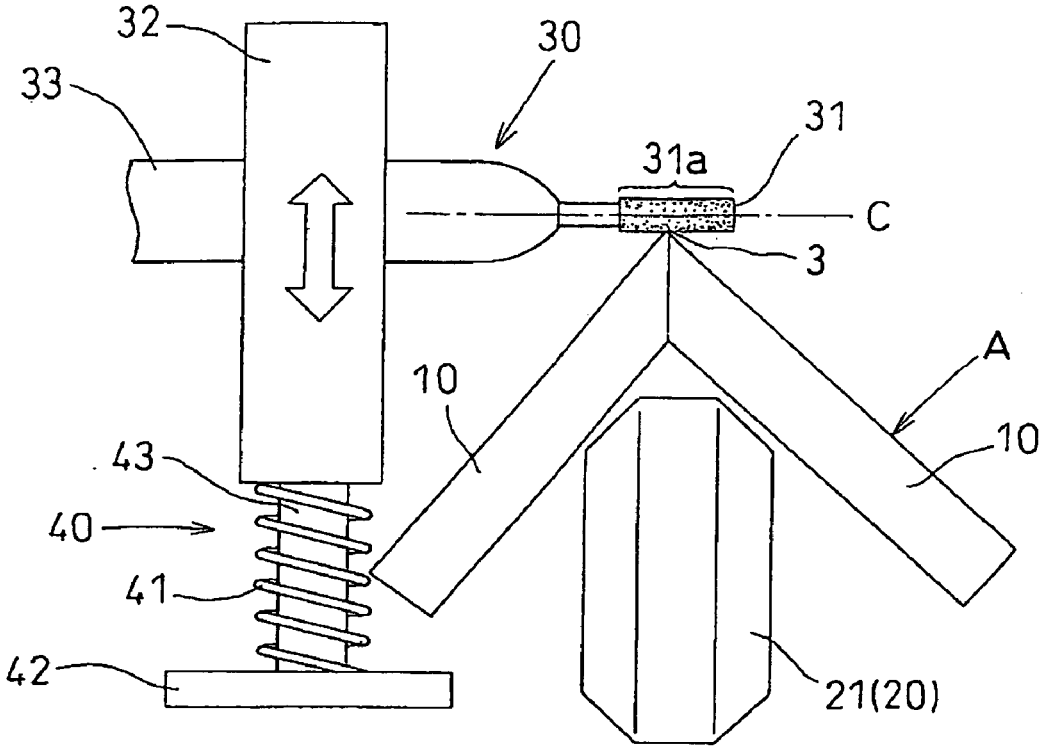
FIG. 5 is a schematic view of an embodiment of an apparatus for chamfering a projected corner column seen from a direction perpendicular to the feeding direction of the projected corner column.
Figure 6:
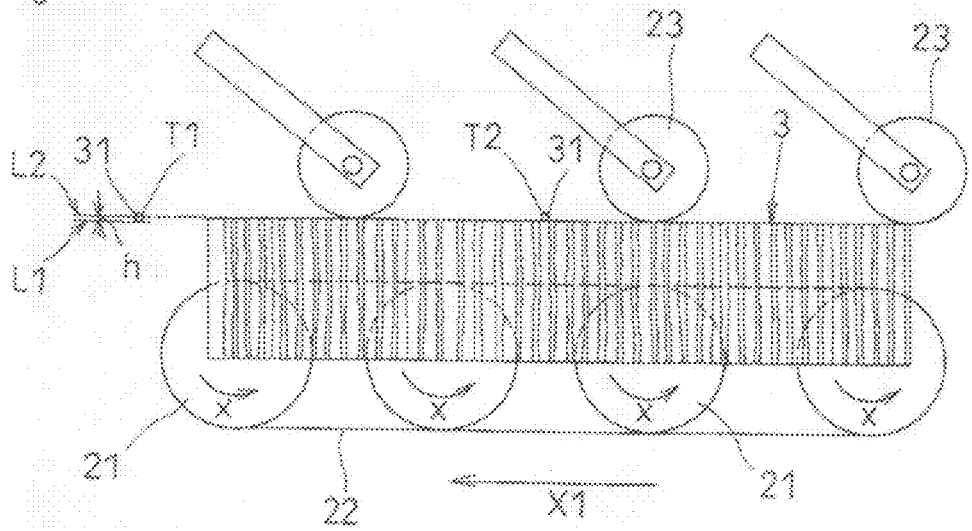
FIG. 6 is a schematic view of the apparatus shown in FIG. 5 seen from a direction parallel to the feeding direction of the projected corner column.
Figure 10:
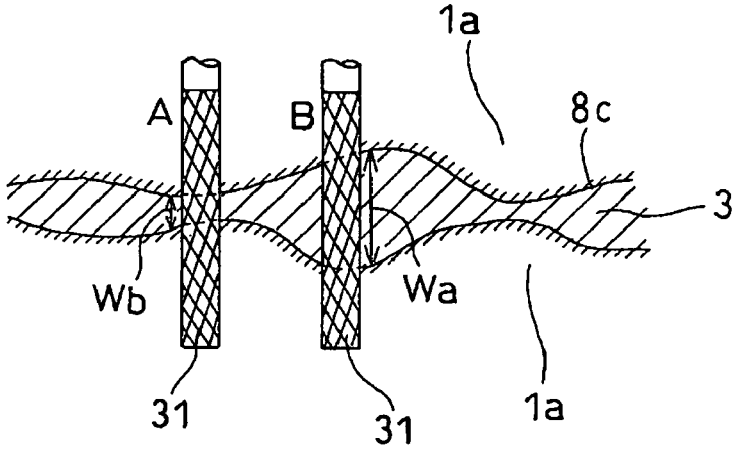
Figure 10:
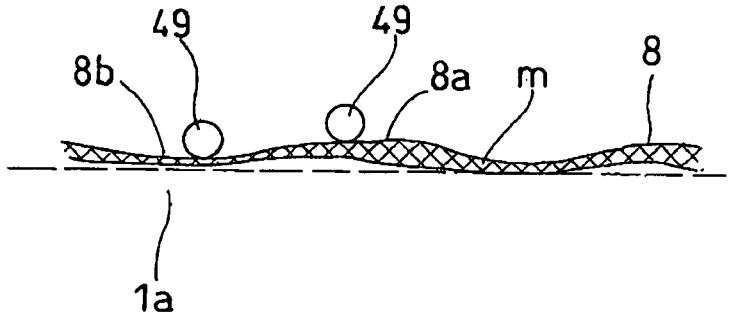

In FIG. 10, FIG. 10*a* is a plain view showing an example of the cut surfaces when chamfering is effected along the apex corner of a projected corner column by using the chamfering apparatus shown in FIGS. 5 and 6, and FIG. 10*b* is a lateral side view of an example of the cut surfaces after post-coating.

Figure 11:
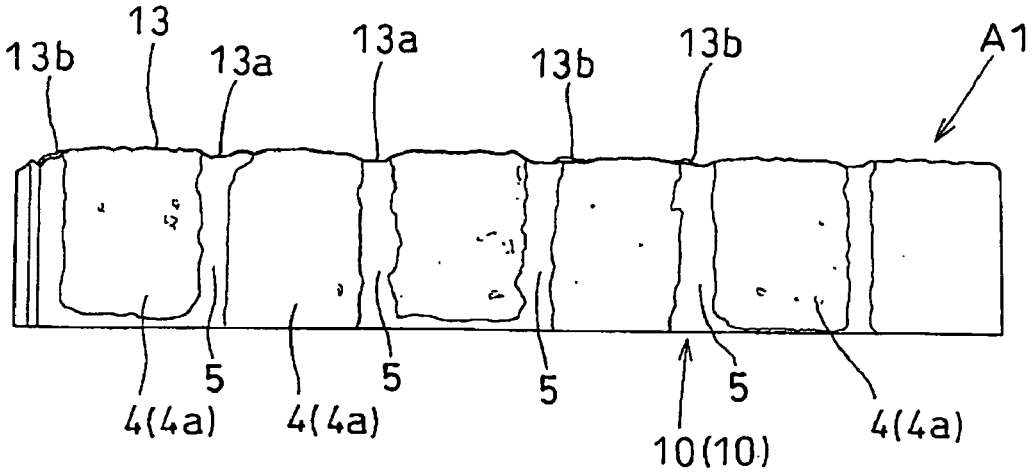

FIG. 11 is a side view of a projected corner column before chamfering.

Figure 12:
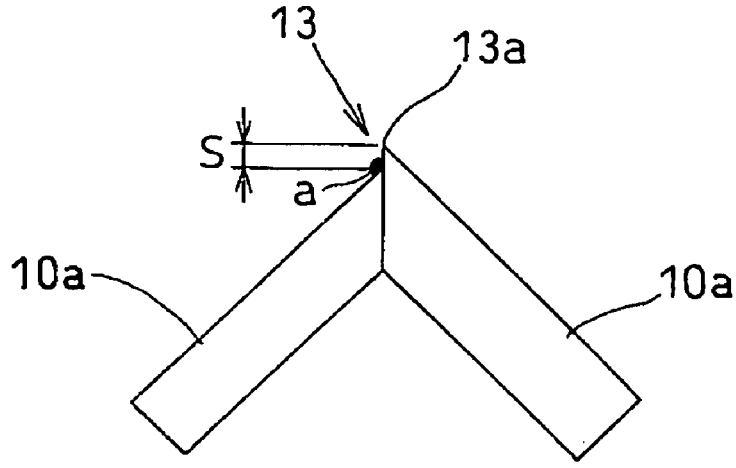

FIG. 12 is a schematic view showing a cross-section of the projected corner column shown in FIG. 11.

Figure 13:
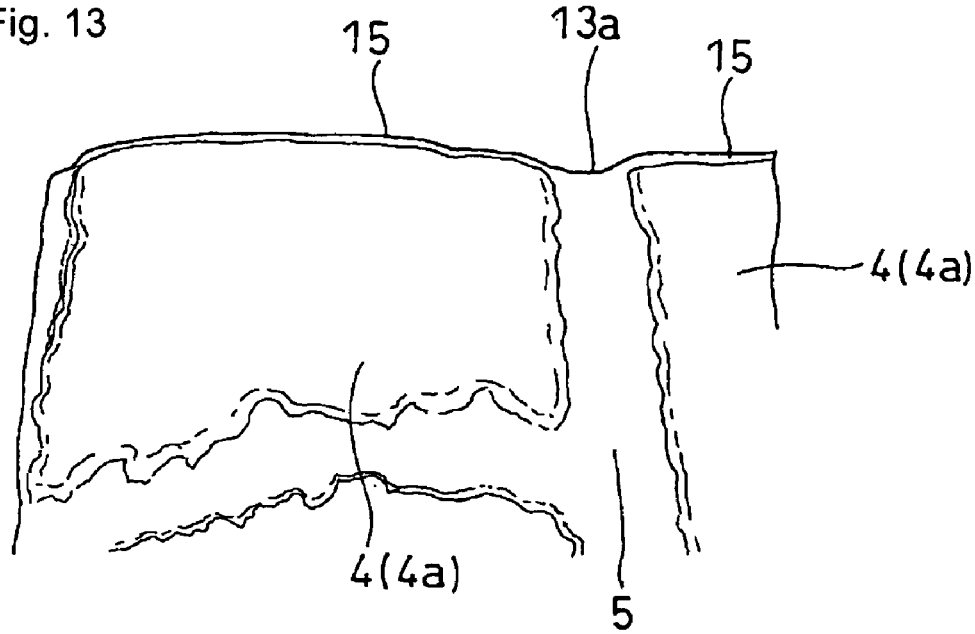

FIG. 13 is a view for explaining a projected corner column after chamfering.

Figure 14:
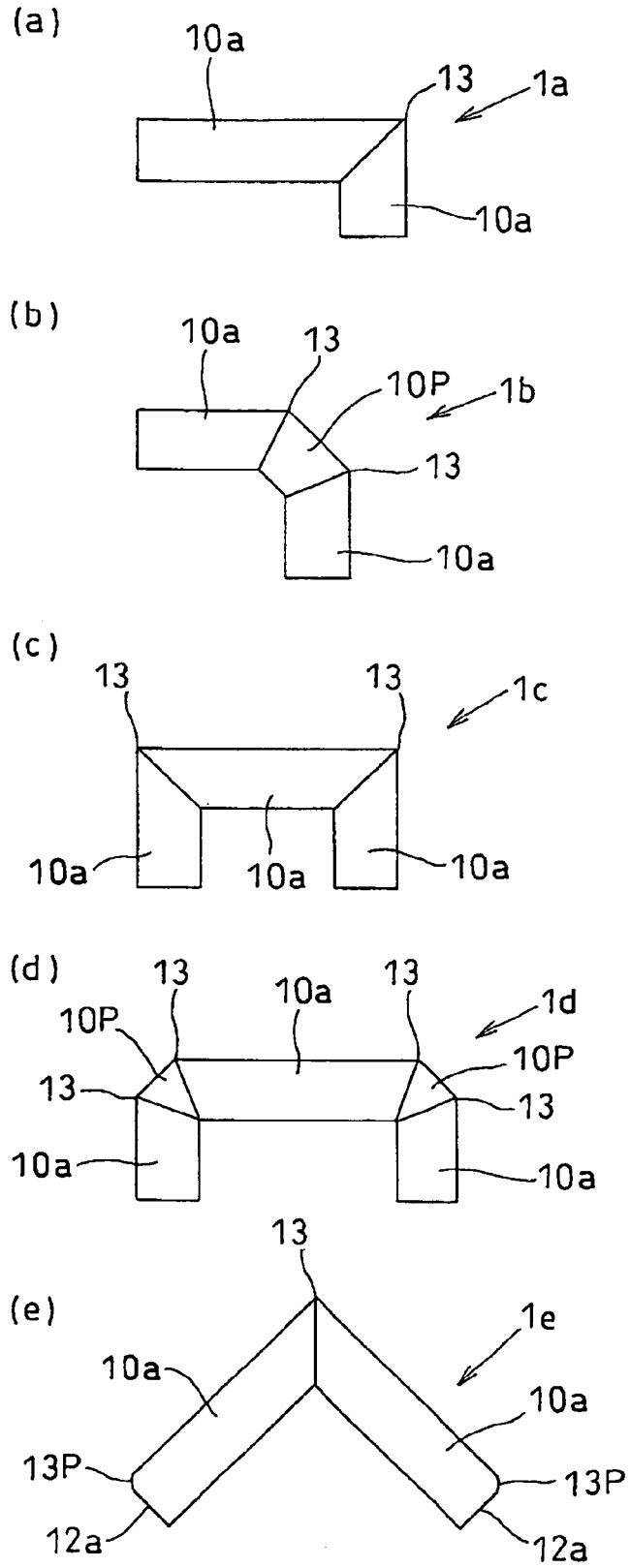

FIG. 14 is a view showing projected corner columns having the other forms.

Figure 15:
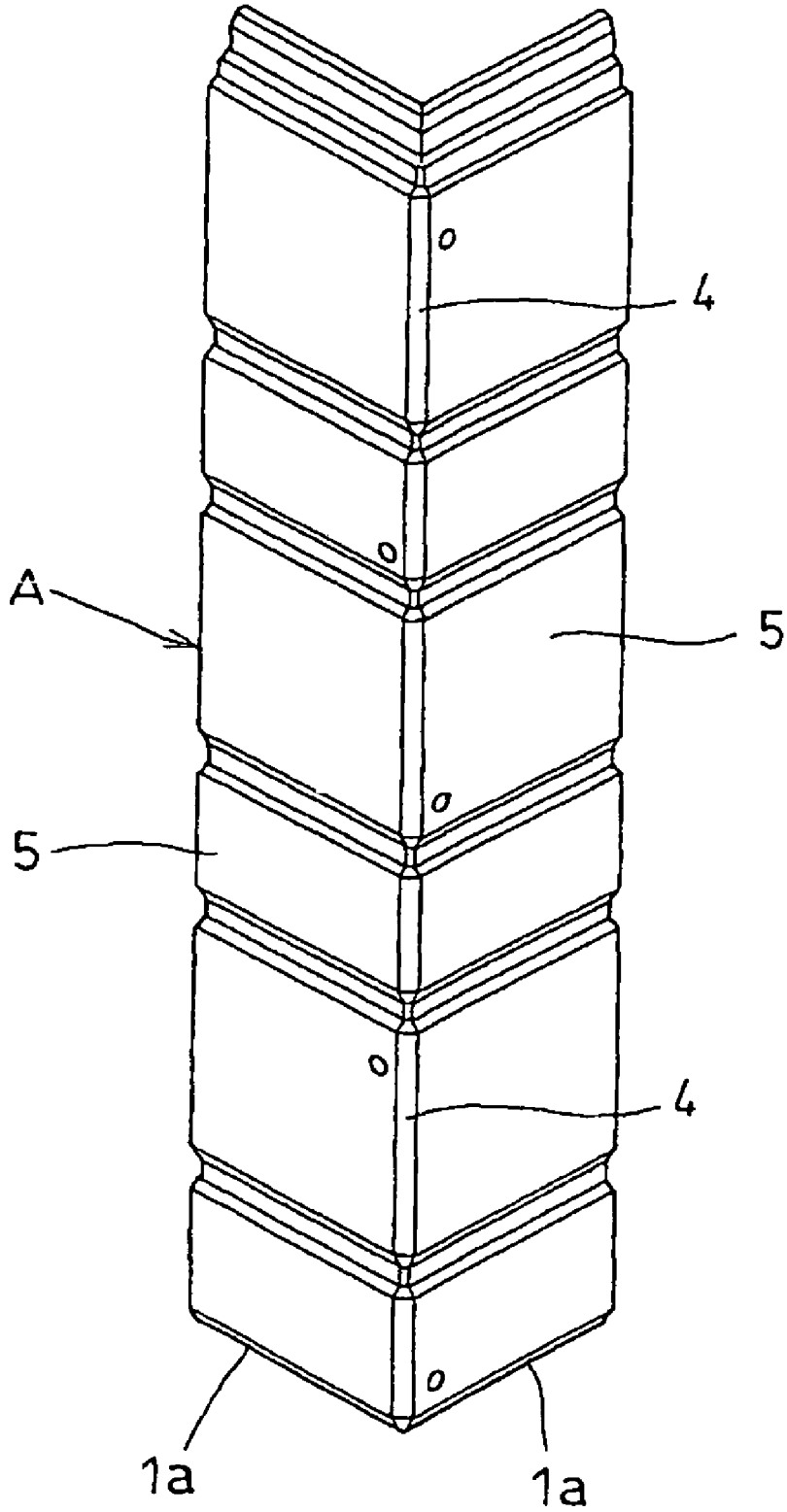

FIG. 15 is a view showing an example of conventional projected corner columns.

Figure 16:
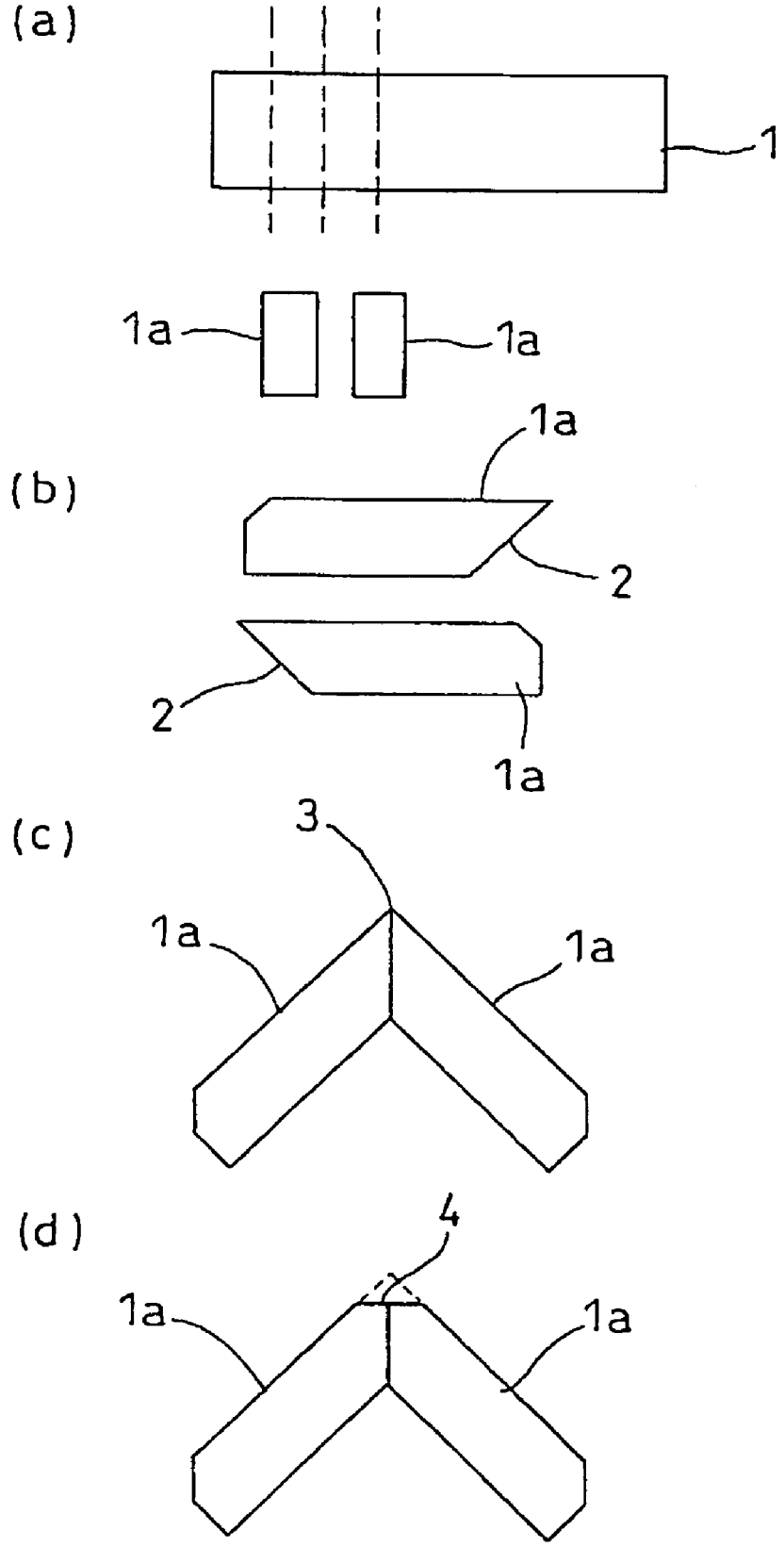

FIG. 16 is a view for explaining an example of methods for producing a projected corner column.

Figure 17:
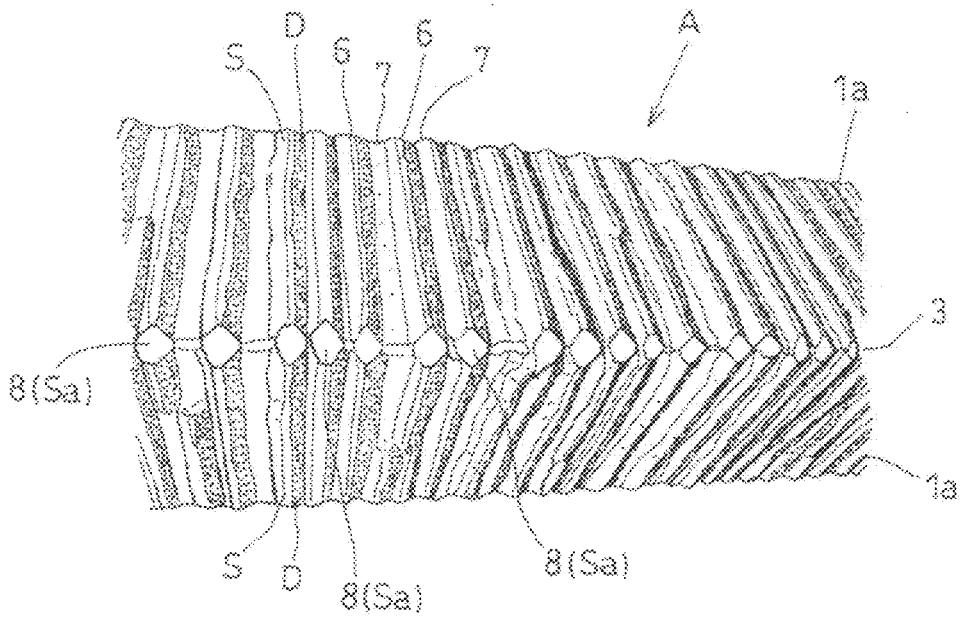

FIG. 17 is a view for explaining a chamfered part of a conventional projected corner column.

Figure 18:
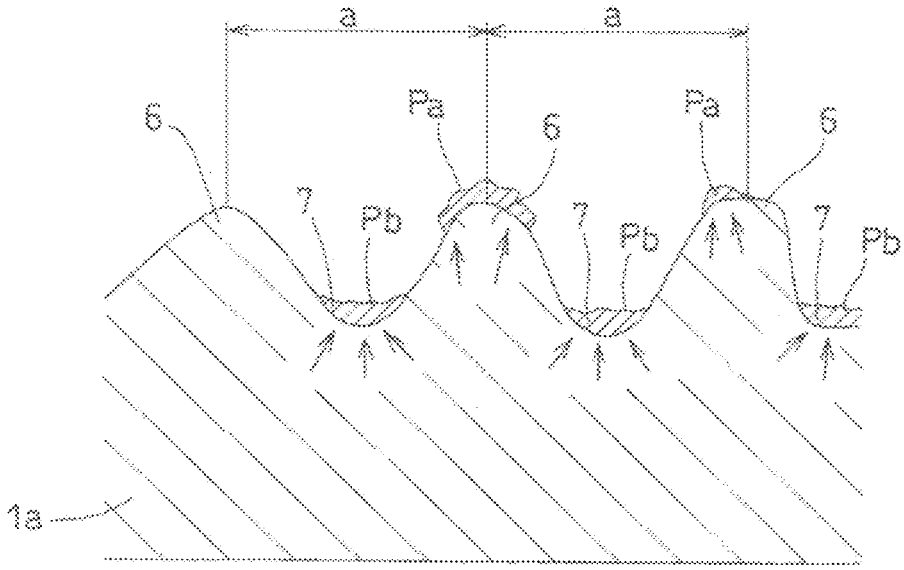

FIG. 18 is a view for explaining protrusion of an adhesive at the apex corner of a projected corner column.

DETAILED DESCRIPTION OF THE INVENTION

Figure 1:
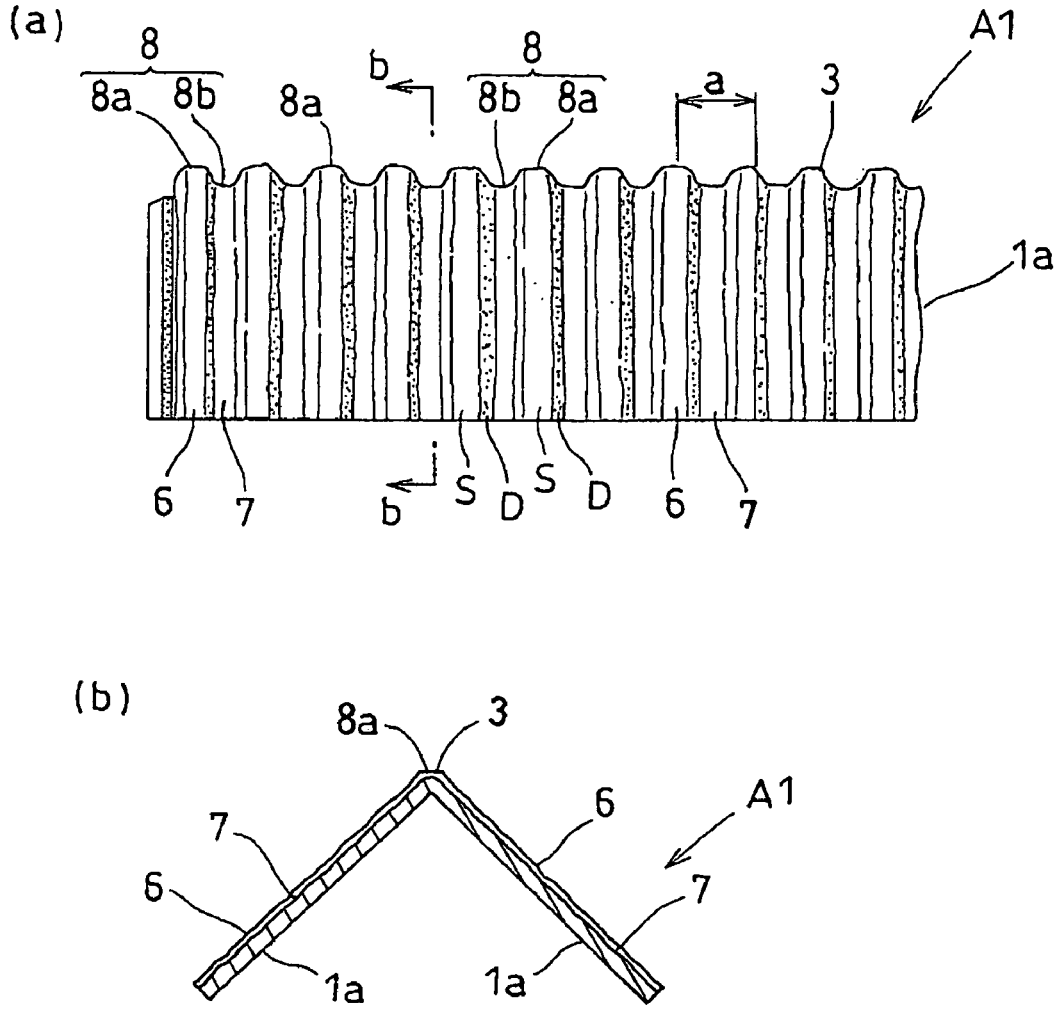
FIG. 1 is a side view (FIG. 1*a*) and a cross-sectional view (FIG. 1*b*) showing an embodiment of projected corner columns according to the present invention.
Figure 2:
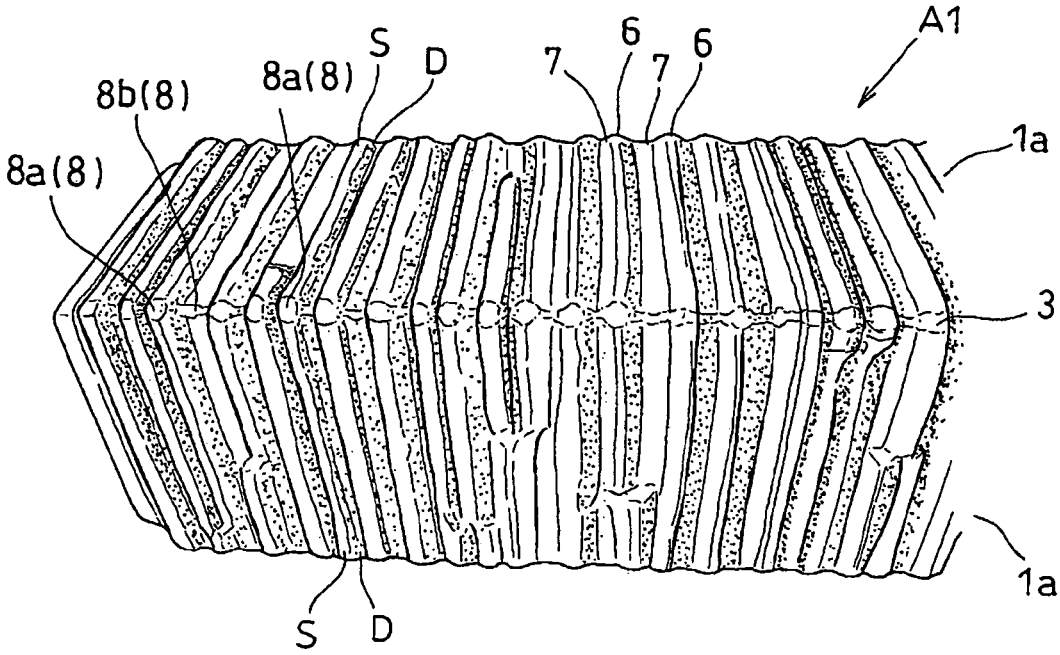
FIG. 2 shows more realistically the projected corner column shown in FIG. 1 seen from above.

The present invention will be explained below referring to drawings. FIG. 1 is a side view (FIG. 1*a*) and a cross-sectional view (FIG. 1*b*) showing an embodiment of a projected corner column A1 of the present invention. FIG. 2 shows realistically the projected corner column A1 seen from above. The projected corner column A1 is made from board pieces 1*a*, 1*a* similar to those used for the projected corner column A shown in FIG. 17, but the shape of a chamfered part on an apex corner of the projected corner column A1 is different from that of the projected corner column A.

As shown, a board piece 1*a* has an embossed pattern consisting of a plurality of convex stripes 6 and a plurality of concave grooves 7 both extending in a direction that intersects with a bonded surface (in a direction perpendicular to the bonded surface in the drawing, although not restricted thereto), and board pieces 1*a*, 1*a* are bonded at an apex corner 3 so that the convexoconcaves of the embossed patterns on the board pieces conform with each other. In this example, particularly in the board piece shown in FIG. 2, in order to create a high quality of design, each convex 6 and each concave 7, respectively, have slightly different shapes, although on average, the distance a between the tops of adjacent convex stripes is approximately 10 mm to 15 mm, and the height from the bottom of the concave groove 7 to the top of the convex stripe 6 is approximately 8 mm on average. Although not shown, when a simple repeated pattern is preferred, a convex stripe and a concave groove each having the same shape may be repeated.

In addition, a moisture-curable adhesive (for example, it a moisture-curable urethane resin adhesive) is suitable for the joining of two pieces of board piece 1*a*, 1*a* constituting projected corner column A1, and it is used, and, for example, for an adhesion hardening method, microwave adhesion technology is suitable, and it is used. After two pieces of board piece 1*a*, 1*a* were bonded, when, around a chamfered part and the neighborhood, it is sprayed water on an apex corner and the neighborhood, it is promoted polymerism and hardening of the moisture-curable urethane resin adhesive. That the adhesive which protruded from the apex corner hangs down along the surface of board piece 1*a*, 1*a* and loses surface design is prevented effectively by it. It is become adhesion solidification one body strongly.

Figure 3:
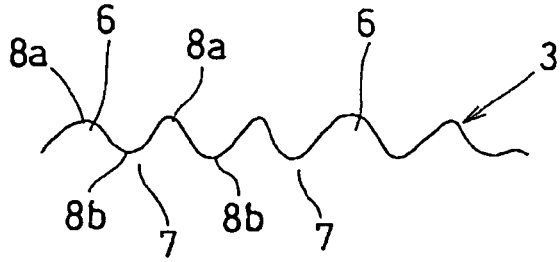
FIG. 3 is a schematic view showing the state of an apex corner of a projected corner column according to the present invention.
Figure 3:
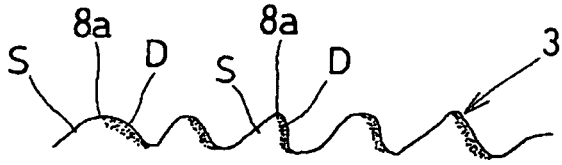

The projected corner column A1 is subjected to chamfering by displacing a rotating air grinder along the convexoconcaves on the apex corner 3 or the like to give a narrow chamfered part 8. And at the narrow chamfered part 8, at least convex regions of an embossed pattern at the apex corner 3 (the part where convex stripes 6 are mutually bonded) form a continuous curved surface 8*a* (also see FIG. 3*a*). Although the concave regions of an embossed pattern at the apex corner 3 (the part where concave grooves 7 are mutually bonded) also form a continuous curved surface 8*b* in this example, the concave regions may not be necessarily subjected to chamfering. The width of the chamfered part 8, namely the maximum width of the continuous curved surface 8*a*, is desirably narrow, and is preferably not more than approximately 8 mm.

By effecting chamfering, it is possible to cut off the protrusion of an adhesive as shown in FIG. 18 and also cut off a deviant part if there is a slight deviance at the apex corner (ridge part) 3 of the bonded part as shown in FIG. 1 and at an ridge line 13*b* shown in FIG. 11. In this way, the region in the vicinity of the apex corner of the bonded part forms a smooth continuous surface, and application of a paint during finish coating becomes favorable.

Because chamfered part 8 is narrow in width as a whole and the convex regions of an embossed pattern form a continuous surface 8*a* at least at the apex corner 3 as shown in FIG. 2, the entire chamfered part 8 is not highly visible in the projected corner column A1 of the present invention, and besides, light parts and shade parts similar to light parts S and shade parts D that generate on the surface patterned parts of the board piece 1*a* when the board piece 1*a* is exposed to daytime sunlight generate on the continuous curved surface 8*a* of the chamfered part 8 (also see FIG. 3*b*), whereby the light parts S and the shade parts D in the left and right board pieces 1*a*, 1*a* appear to be continuous. Therefore, a viewer can feel that the embossed patterns on the left and right board pieces 1*a*, 1*a* are continuous as a whole, and the chamfered part becomes less visible.

Figure 4:
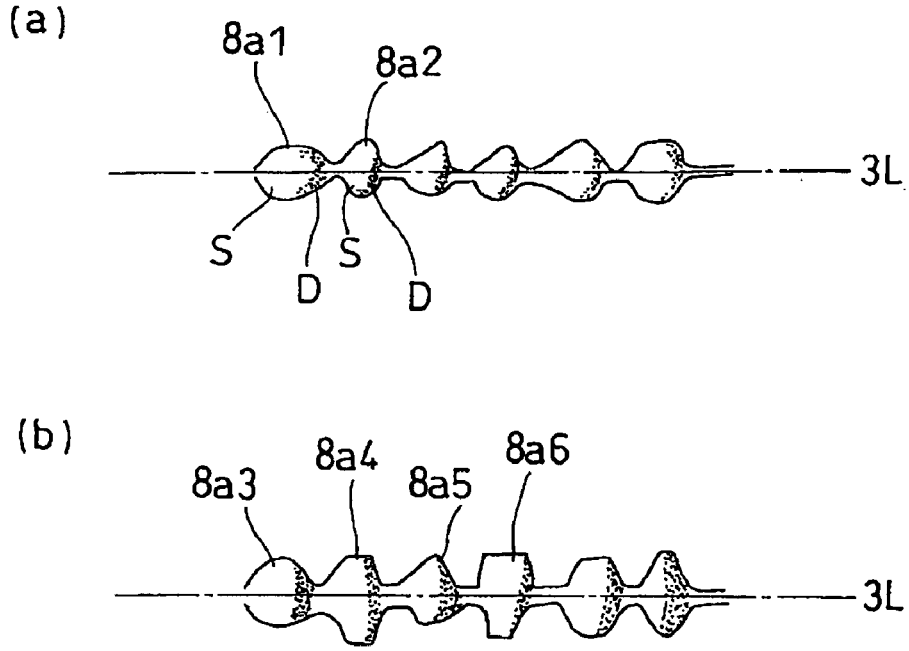
FIG. 4 is a schematic view of a plain view shape of parts of a chamfered part of a projected corner column according to the present invention, said parts corresponding to the convex regions of mainly an embossed pattern.

FIG. 4 shows a plain view shape of a part of the chamfered part 8 in the projected corner column A1 of the present invention, said part mainly corresponding to the convex region of an embossed pattern. As mentioned previously, the term "plain view shape" refers to a shape visually confirmed when the projected corner column A1 is placed on a plain surface with the apex corner 3 turning up and the chamfered part formed on the apex corner 3 is looked down from a position above the line 3L that divides the apex corner 3 into two equal parts. In the example shown in FIG. 4*a*, at least adjacent parts, for example, curved surfaces 8*a*1 and 8*a*2, are different from each other in a plain view shape. In the case of a simple repeated pattern, naturally the same shape is repeated. FIG. 4*b* shows another example showing a plain view shape of a continuous curved surface 8*a* at a part corresponding to the convex regions of an embossed pattern, and the plain view shape may include various shapes such as approximately circular (8*a*3), trapezoidal (8*a*4), triangular (8*a*5) and rectangular (8*a*6) shapes.

Plain view shapes including the above-mentioned various shapes can be readily obtained by changing the shape of the convex region (convex stripe 6) of an embossed pattern in the vicinity of the apex corner 3. Also by changing the cutting amount, different plain view shapes can be obtained.

The projected corner column A1 as described above can be readily produced by using an apparatus explained below. FIG. 5 is a schematic view of an embodiment of an apparatus for chamfering the projected corner column A1 of the present invention seen from a direction perpendicular to the feeding direction of the projected corner column, and FIG. 6 is a schematic view of the apparatus seen from a direction parallel to the feeding direction of the projected corner column.

The apparatus shown in FIGS. 5 and 6 is equipped with an projected corner column-supporting means 20 provided with a feeding roller 21, a chamfering means 30 provided with an air grinder 31, and a chamfering means-supporting means 40 provided with a coil spring 41 as an elastic body. By actuating the feeding roller 21, the projected corner column A1 supported by the projected corner column-supporting means 20 displaces relative to the fixed chamfering means 30.

The projected corner column-supporting means 20 is provided with plural feeding rollers 21 aligned horizontally, and the rollers are entirely wound by a flat belt 22 to stabilize feeding. Similarly to conventional methods, the projected corner column A1 having an approximately L-shaped cross-section is placed on the feeding roller 21 with the apex corner 3 exposed upward, and by rotating the feeding roller 21 in a direction shown by an arrow x, the projected corner column A1 is displaced in a direction shown by an arrow X1. In order to stabilize feeding of the projected corner column A1, it is desirable to provide a holding roller 23 as shown in FIG. 6 although it may be omitted.

At a position lateral to the projected corner column-supporting means 20, provided is a supporting pole 43 mounted on a fixed machine casing 42, and a block 32 that constitutes apart of the chamfering means 30 is attached movably up and down to the supporting pole 43. The block 32 is provided to impart a predetermined load necessary for cutting to the chamfering means 30, and a load with a weight suitable for a real machine is selected. The block 32 is provided with a pneumatic rotating apparatus 33 connected to an optional pneumatic source, and at an end of the pneumatic rotating apparatus 33 is attached an air grinder 31 with an axis of rotation C held horizontally. As shown in FIG. 5, the axis C of the air grinder 31 is directed to a direction perpendicular to the feeding direction X1 of the projected corner column A1, and a cutting region 31*a* thereof is placed on the projected corner column A1 in such a way that the region 31*a* is orthogonalized to the ridge line of the apex corner 3 of the fed projected corner column A1.

Figure 7:
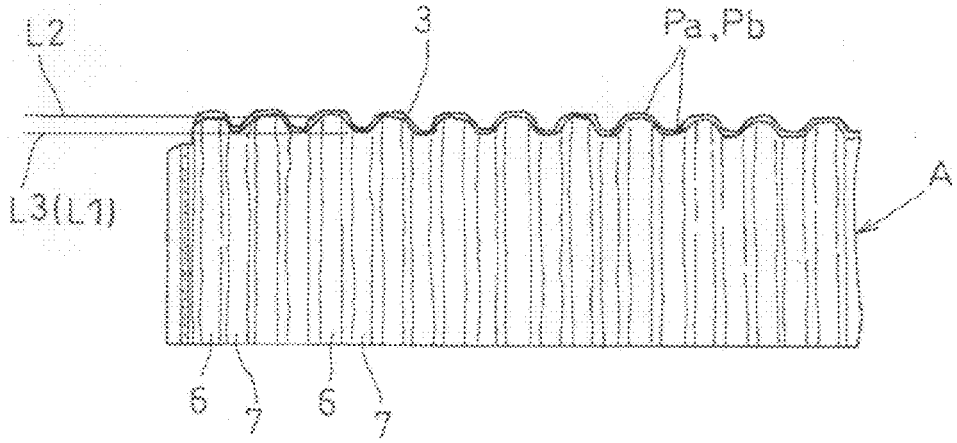
FIG. 7 is a side view showing a projected corner column before chamfering.
Figure 8:
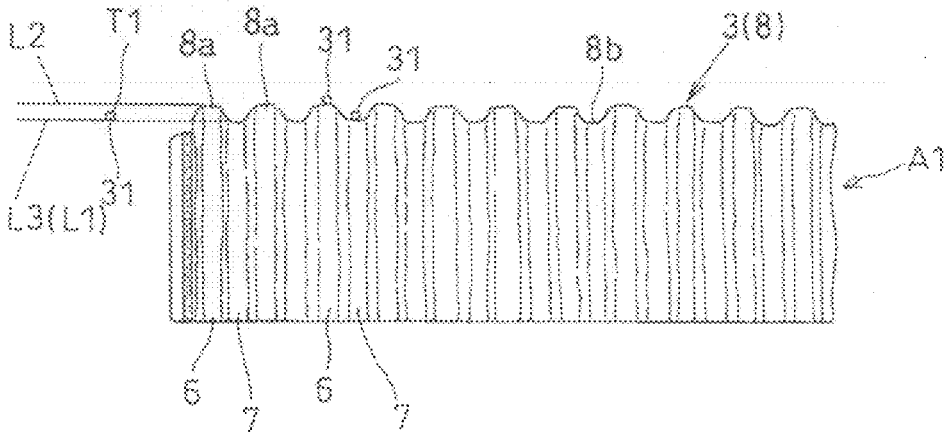
FIG. 8 is a schematic view showing an example of chamfering.

Between the fixed machine casing 42 and the block 32 is arranged a coil spring 41 placed around the supporting pole 43. The strength of the coil spring 41 (rate of spring) is adjusted so that, when the block 32 is placed on the coil spring 41 in a free state, a level L1 of the lowest surface of the air grinder 31 comes to a position lower than the level L2 of the apex corner 3 of the fed projected corner column A1 by a predetermined distance h (at position T1 in FIG. 6). Actually, when a number of projected corner columns A1 are chamfered successively, the level L2 of the apex corner 3 of each projected corner column slightly varies. Accordingly, an expected average value is used as the level L2. The level L1 is set to a level L3 of the concave grove 7 in the apex corner 3 as shown in FIG. 7 which shows the projected corner column A1 before chamfering, or to a level slightly lower than the level L3. Incidentally, in FIG. 7, Pa and Pb show protruded adhesive parts which appear during bonding as explained in term of FIG. 17.

While rotating the air grinder 31 at a rate of, for example, approximately 25000 rpm, the projected corner column A1 is fed. The block 32 receives an upward force from the coil spring 41, and thus can readily move upward and automatically ride on the apex corner 3 of the fed projected corner column A1.

With the air grinder 31 ridden on the apex corner 3 as shown by T2 in FIG. 6, the projected corner column A1 is fed in a direction shown by arrow X1. Owing to the presence of the coil spring 41, the load acting on the cutting surface (namely, the apex corner 3) is small as mentioned above. The air grinder 31 cuts (chamfers) the ridge line of the apex corner 3 with moving up and down as if it traces the convexoconcaves generated on the apex corner 3 [convexoconcaves formed by the convex regions (parts where convex stripes 6 are mutually bonded) of embossed patterns and the concave regions (parts where concave grooves 7 are mutually bonded) of the embossed pattern at the apex corner 3]. Thus, the protruded adhesives Pa and Pb are cut off and simultaneously chamfering with a predetermined depth proceeds at the apex corner 3. As a result, a chamfered part 8 with a shape as if the above-mentioned convexoconcaves that the apex corner 3 initially had are traced is formed on the ridge of the projected corner column A1 after chamfering, whereby the processed part 8 has a continuous curved surface 8*a*.

By appropriately adjusting the rate of spring of the coil spring 41 in compliance with the hardness of the apex corner 3 of the projected corner column A1 to be chamfered in the above apparatus, a cutting depth or a shape of the curved surface can be optionally adjusted. In addition, since the cutting depth and flatness of a cut surface vary depending on the feeding rate of the projected corner column A1 and the number of revolutions of the air grinder 31, a coil spring 41 having an optimum rate of spring determined experimentally or by calculation may be selected in compliance with the aimed width of the chamfered part and the degree of the convexity and concavity. Generally, if the number of revolutions of the air grinder 31 is low, a deep cutting is obtained whereas if the number of revolutions of the air grinder 31 is high, a shallow cutting is obtained. A feeding rate in a range of from 10 cm/sec to 20 cm/sec is appropriate although a low feeding speed results in deep cutting while a high feeding speed results in shallow cutting.

Although not shown, a fixed cutting device may be arranged upstream the air grinder 31 in the feeding direction of the projected corner column A1. By setting the fixed cutting device at a position somewhat higher than the level L2 (an average level) of the apex corner 3 of the fed projected corner column A1, it is possible to preliminarily cut a part of the ridge that protrudes beyond a predetermined value or a protruded adhesive part if a projected corner column having such part or adhesive part is fed, whereby avoiding a case where the air grinder 31 moving up and down cuts only the protruded ridge part and terminates chamfering.

By effecting the chamfering using the apparatus shown in FIG. 5, formed on the ridge part of the projected corner column A1 after chamfering is a narrow chamfered part 8 which has a width in compliance with the above embossed pattern (a pattern in which the convex stripe 6 and a concave groove 7 are repeated) that the apex corner 3 initially had and has irregular convexoconcaves rather than a flat surface. Depending upon the load applied to the air grinder 31 that acts on the apex corner 3, usually a coat consisting of multiple layers that has been initially formed is removed from the chamfered part 8 and a base material of the board piece 1*a* is exposed.

Figure 9:
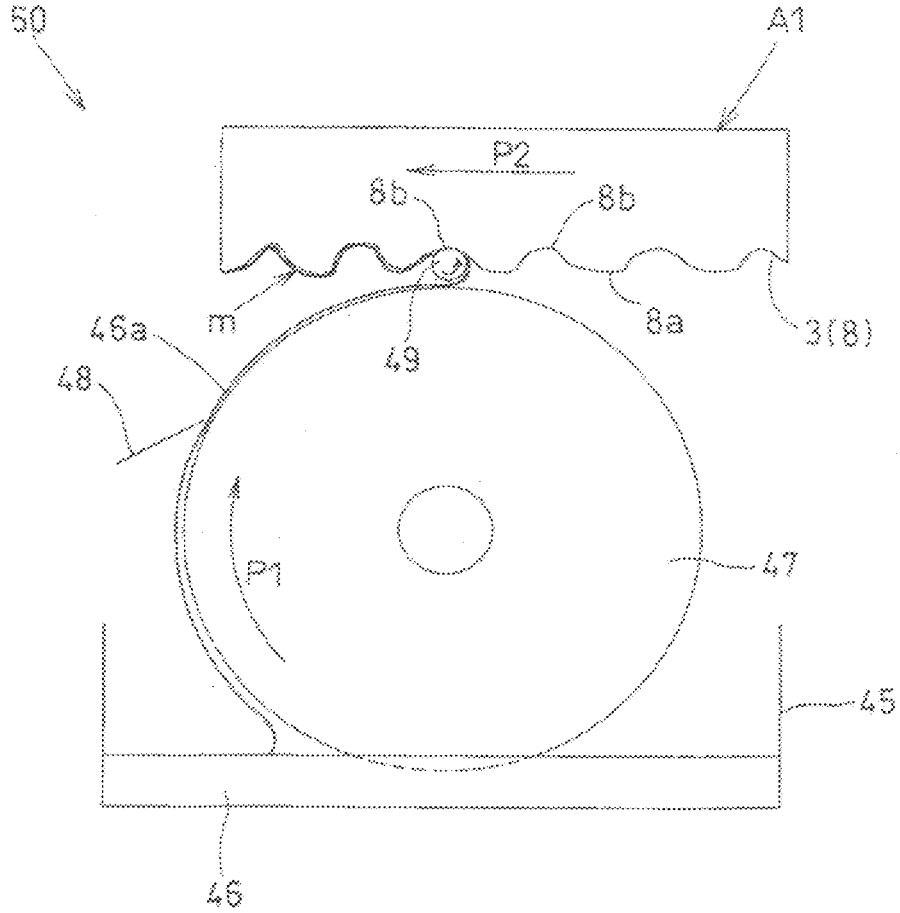
FIG. 9 is a view showing an example of coating apparatuses for coating a chamfered part of a projected corner column according to the present invention.

Next, a coat is formed by post-coating on the chamfered part 8 of the projected corner column A1. A method of forming a coat m is optional although a uniform coat m can be formed readily and without fail by using, for example, a coating apparatus 50 shown in FIG. 9. In FIG. 9, numeral 45 denotes a paint reservoir, and an optional paint 46 is contained therein. A paint supply roller 47 is located so that a part thereof is immersed in the paint 46 in the paint reservoir 45, and rotates in a direction shown by arrow P1 by means of a driving apparatus not shown. Upon rotation of the paint supply roll 47, the paint 46 adheres to a peripheral surface of the paint supply roller 47 and is drawn up. A adjusting blade 48 is attached in the vicinity of the peripheral surface of the paint supply roller 47 and adjusts the thickness of a coat 46*a* to be drawn up.

Above the paint supply roller 47 is placed a coating roller 49 having such a diameter small enough to get into concave parts 8*b* of the narrow and irregular convexoconcaves (convex parts 8*a*, concave parts 8*b*) which have a width in compliance with the embossed patterns on the board pieces 1*a*, 1*a* and which are formed on the chamfered part 8 of the projected corner column A1 to be post-coated. The peripheral surface of the coating roller 49 may be in contact with the peripheral surface of the paint supply roller 47 so that the roller 49 passively rotates through contact friction or may not be in contact therewith. In the latter case, the gap between them is preferably about 0.3 mm to 1.0 mm. In the case of contact-free state, the coating roller 49 may be provided with a driving apparatus or may be passively rotated through contact friction by the projected corner column A1 to be coated.

The entire paint supply roller 47 and coating roller 49 are biased upwardly by an appropriate bias means not shown. The projected corner column A1 to be coated is fed in a direction shown by the arrow P2 by an optional feeding means in such a way that the chamfered part 8 is pressed against the coating roller 49. Together with the displacement of the projected corner column A1, the paint supply roller 47 and the coating roller 49 move up and down along the convexoconcaves formed on the chamfered part 8 of the apex corner 3 of the projected corner column A1, and the coating roller 49 never departs from the convexoconcaves (convex parts 8*a*, concave parts 8*b*) formed on the chamfered part 8.

Incidentally, the paint supply roller 47 may be made of a metal such as iron, stainless steel or aluminum, or a resin, and is preferably made of a metal, particularly stainless steel in view of wear resistance and durability. Also the coating roller 49 may be made of a metal or a resin, and is preferably made of a hard metal or a hard alloy in view of durability. In this respect, it is desirable to use a knurling-processed one, and specifically it is desirable to use for the coating roller 49 a grinder bit used for chamfering of the apex corner.

A coat 46*a* formed on the periphery of the paint supply roller 47 is transferred (transcribed) from the periphery of the paint supply roller 47 to the coating roller 49, and then transferred from the coating roller 49 to the chamfered part 8 of the projected corner column A1, whereby a desired coat m is formed thereon. As mentioned above, the coating roller 49 has such a small diameter that it can get into the concave parts 8*b* of the chamfered part 8 and thus a coat m having a uniform thickness is formed on the whole region of the chamfered part 8, namely, not only on the convex parts 8*a* but also on the concave parts 8*b*, as well shown in FIG. 1*a*.

In the projected corner column A1 having the coat m thus formed on the chamfered part 8, the chamfered part 8 as a whole is not highly visible, and generates, on the convex parts 8*a* and concave parts 8*b* of the chamfered part 8, light parts and shade parts similar to the light parts S and shade parts D that generate on the surface patterned parts of the board pieces when exposed to daytime light as particularly shown in FIG. 2, whereby the light parts S and the shade parts D in the left and right board pieces 1*a*, 1*a* appear to be continuous. Therefore, a viewer can feel that the embossed patterns on the left and right board pieces are continuous as a whole, and thus the chamfered part becomes less visible.

As explained with regard to FIGS. 5-8, when chamfering is effected along the apex corner 3 of the projected corner column A1, the width Wb of a surface cut by the grinder bit 31 is as narrow as about 2 mm at the concave part 8*b* and the width Wa is as wide as about 7 mm at the concave part 8*a* in many cases. And between the chamfered part 8 and the embossed patterns on the board pieces 1*a*, 1*a*, boundary parts (boundary regions) 8*c* which are cut cross-sections of the coat 9 on the surface patterned part appear.

If the resulting chamfered part 8 is subjected to coating by using a coating apparatus 50 shown in FIG. 9, the area of the chamfered part 8 that contacts the coating roller 49, namely the area over which the paint spreads, differs between the convex part 8*a* and the concave part 8*b* from each other. Therefore, the coat m formed by post-coating follows the width of the irregular convexoconcaves formed on the chamfered part 8 (for example, width Wa or Wb, provided that the above-described "boundary part (boundary region) 8*c*" is involved).

During the post-coating, depending on the thickness and the amount of the paint adhered to the coating roller 49 or physical properties of the paint, as well as on the shape of irregular convexoconcave formed on the chamfered part seen from a lateral direction, the paint may flow beyond the boundary parts (boundary regions) 8*c* between the chamfered part 8 and the embossed patterned parts of the board pieces 1*a*, 1*a* into the surface patterned parts of the board pieces 1*a*, 1*a*. FIG. 10*b* shows a side view of the part shown in FIG. 10*a* after coating in such case, and although the lower edge of the coat m formed by post-coating is slightly waved with about 0.1 mm to 1.0 mm in maximum height, it is approximately linear seen from a distant place in many cases (in the present invention, the term "approximately linear" is used in this meaning).

When the coating apparatus 50 shown in FIG. 9 is used, the thickness of the coat 46*a* can be changed by adjusting the distance between the tip of the adjusting blade 48 and the periphery of the paint supply roller 47, and, as a result, the amount of paint applied to the chamfered part 8 varies. As mentioned above, by appropriately adjusting the amount of paint, it is possible to obtain projected corner columns of various forms such as a projected corner column in which the coat m formed by post-coating follows the width of irregular convexoconcave formed on the chamfered part 8, a projected corner column in which the coat m reaches slightly the emboss patterned part beyond the boundaries between the chamfered part 8 and the emboss patterned parts of the board pieces 1*a*, 1*a*, or a projected corner column in which the lower edge of a coat m formed by post-coating is approximately linear when the projected corner column is seen laterally as shown in FIG. 10*b*.

Further, by using an apparatus 50 shown in FIG. 9 and effecting coating twice or more by changing the type of paints 46 for the same projected corner column, it is possible to obtain a post-coated film m consisting of two or more coat layers. In this case, the chamfering part 8 of a projected corner column A1 may be coated with the same coat as the multiple-layered coat 9 formed on the surface patterned part, whereby giving an external corner pole having a more natural appearance.

FIG. 11 is a side view of a projected corner column A1 obtained by bonding two board pieces 10*a*, 10*a* and shows a state prior to chamfering. In FIGS. 1-7, the board piece 1*a* has an embossed pattern consisting of a plural number of convex stripes 6 and a plural number of concave grooves 7 both extending in a direction perpendicular to the bonded surface whereas in FIG. 11, the board piece 10*a* has a plural number of groove parts 5 and a plural number of convex regions 4 defined by the groove parts. Surface concavo-convex patterned parts 4*a* of 0.3 mm to 5 mm in depth are formed on the convex regions 4.

For bonding the two board pieces 10*a*, 10*a* which constitute the projected corner column A1, a moisture-curable adhesive (for example, a moisture-curable urethane resin adhesive) is suitably used, and as a method for curing the adhesive, a microwave adhesion technique is suitably used. Although not shown, after bonding the two board pieces 10*a*, 10*a*, polymerization and curing of the moisture-curable urethane resin adhesive can be accelerated by spraying water centering around the cut surface and the vicinity thereof, as well as the apex corner and the vicinity thereof. Thus, it is possible to effectively prevent the adhesive protruded from the apex corner from trailing down along the surface of the board piece 10*a* and impairing the design of the surface, and also to firmly adhere the board pieces with each other, solidify the adhesive and integrate the board pieces.

In the projected corner column A1 in which the board pieces 10*a*, 10*a* have been bonded, convexoconcave due to the surface concavo-convex patterned part 4*a* formed on the convex region 4 remains at the ridge of the apex corner 13, and the apex corner 13*a* corresponding to the groove 5 is located at a position lower than that of the ridge of the apex corner 13 by the depth of the groove 5, as shown in a drawing. Incidentally, numeral 13*b* in FIG. 11 denotes a ridge of a board piece 10*a* located at the opposite side (also refer to FIG. 12). FIG. 12 shows schematically a cross-section of a projected corner column A1 in which, as mentioned above, convexoconcaves extending in the ridge direction and misalignment S of the edges of the left and right board pieces 10*a*, 10*a* are liable to produce at the apex corner 13, and an adhesive-protruded part a also exists.

The projected corner column A1 in this state is placed on the projected corner column-supporting means 20 in the above-mentioned apparatus 30 and chamfering is effected on the apex corner 13. For the reason already described, the air grinder 31 cuts (chamfers) the ridge part of the apex corner 13 with moving up and down as if tracing the convexoconcaves generated on the apex corner 13 and thus a concavo-convex surface 15 having a small width (for example, a width of approximately 2 mm to 5 mm) and having such a shape that the convexoconcaves that the apex corner 13 initially had have been traced is formed as shown in FIG. 13 that shows a projected corner column A1 after chamfering. When a cured adhesive protrudes from the bonded surface at the apex corner 13, an up and down movement of the air grinder 31 occurs due to the interference with the adhesive, whereby a concavo-convex shape of the concavo-convex surface 15 may change to a shape different from the concavo-convex shape that the apex corner 13 initially had.

Thereafter, the chamfered part is subjected to an appropriate coating to give a projected corner column. By applying coating necessary to approach the surface concavo-convex patterned part 4*a*, an odd sensation due to difference in color tone can be reduced. In addition, because of a concavo-convex surface 15, it is possible to produce on the chamfered part a shade that approaches the shade that generates on the groove part 5 or on surface concavo-convex patterned part 4*a* of the board piece 10*a*, whereby the presence of the chamfered part itself becomes less visible.

When a misalignment S of the edges of the left and right board pieces 10*a*, 10*a* (see FIG. 12) is large, it is possible to preliminarily cut a largely protruded part by a predetermined height by using an apparatus equipped with a fixed cutting tool (not shown), whereby a projected corner column having a chamfered part with an approximately desired concavo-convex surface 15 can be obtained.

Incidentally, in the above embodiment, although a projected corner column A1 having an apex corner 3 (13) formed by two board pieces 1*a*, 1*a* (10*a*, 10*a*) having the same size and intersecting with each other at an angle of 90 degrees is chamfered, it is an example of the projected corner columns A1 and the whole shape of a projected corner column is not restricted thereto. A projected corner column may partly have a broad pattern.

In the above embodiment, although a projected corner column A1 having an apex corner 13 formed by two board pieces 10*a*, 10*a* having the same size and intersecting with each other at an angle of 90 degrees is chamfered, it is an example of the projected corner columns A1 and there are many other forms. FIG. 14 shows schematically cross-sections of these forms. A projected corner column 1*a* shown in FIG. 14*a* is different from the above-described one in that two board pieces 10*a*, 10*a* are different from each other in width, and a projected corner column 1*b* shown in FIG. 14*b* is different from the above-described one in that a second board piece 10P is sandwiched between two board pieces 10*a*, 10*a* and two apex corners 13, 13 are included in one projected corner column.

In a projected corner column 1*c* shown in FIG. 14*c*, three board pieces 10*a* are bonded one another to give a U shaped body and the projected corner column includes two apex corners 13. In a projected corner column 1*d* shown in FIG. 14*d*, each of second board pieces 10P is sandwiched between two board pieces and four apex corners 13 are included in one projected corner column.

For the apex corner 13 of the projected corner column 1*a*, 1*b*, 1*c* or i*d* having such form, it is certainly possible to make a chamfered part less visible by chamfering similarly to the above.

A projected corner column 1*e* shown in FIG. 14*e* is different from the above-described one in that a chamfered part is also formed on a surface ridge 13P of the side (end surface of lumber) 12*a* opposite to the side which forms an apex corner 13 of board pieces 10*a*, 10*a*. By chamfering the end surface of lumber 12*a*, continuity in appearance with a ceramic building board of a building body can be ensured.

What is claimed is:

1. A projected corner column which is formed by bonding at least two board pieces in such a way that one of the edges of one board piece is bonded to that of the other board piece to form an apex corner, the at least two board pieces having embossed patterns different from each other in the vicinity of the apex corner and/or embossed patterns where convex regions of the embossed patterns are different at least between adjacent convex regions, characterized in that a chamfered part with a narrow width is formed on the apex corner, and said chamfered part has a concavo-convex surface having irregular convexo-concave rather than a flat surface characterized in that grooves extending in a direction perpendicular to the apex corner are formed on the surface of the board piece, and the contact surface between concave part corresponding to said groove and the chamfered part formed on the apex corner is a curved surface.

2. The projected corner column according to claim 1, which is characterized in that grooves and convex regions defined by the grooves are formed on the surface of the board piece, and surface concavo-convex patterned parts are formed on the convex regions.

3. A projected corner column which is formed by bonding at least two board pieces in such a way that one of the edges of one board piece is bonded to that of the other board piece to form an apex corner, the at least two board pieces having embossed patterns different in the vicinity of the apex corner and/or embossed patterns where convex regions of the embossed patterns are different at least between adjacent convex regions, characterized in that said board piece has, as a surface patterned part, the embossed pattern extending in a direction that intersects with the bonded surface, a narrow chamfered part is formed on the apex corner, and the narrow chamfered part forms a continuous curved surface at least in convex regions of the embossed pattern at the apex corner.

4. A projected corner column which is formed by bonding at least two board pieces in such a way that one of the edges of one board piece is bonded to that of the other board piece to form an apex corner, the at least two board pieces having embossed patterns different in the vicinity of the apex corner and/or embossed patterns where convex regions of the embossed patterns are different at least between adjacent convex regions, characterized in that said board piece has, as a surface patterned part, the embossed pattern extending in a direction that intersects with the bonded surface, a narrow chamfered part is formed on the apex corner, and the narrow chamfered part generates light parts and shade parts that are similar to light parts and shade parts which generate on the surface patterned parts of the board pieces when the projected corner column is exposed to a light.

5. The projected corner column according to claim 3, wherein plain view shapes of the parts corresponding to the convex regions of the embossed pattern are different from each other at least at adjacent convex regions in the narrow chamfered part.

6. The projected corner column according to claim 1, wherein the maximum width of the narrow chamfered part is not more than 8 mm.

7. The projected corner column according to claim 1, wherein two board pieces are bonded by using a moisture-curable adhesive.

8. The projected corner column according to claim 7, wherein water is supplied to an end of lumber or the apex corner and the vicinity thereof before said adhesive cures and thereafter the adhesive is cured.

9. The projected corner column according to claim 7, wherein said curing is effected by utilizing microwave heating.

10. The projected corner column according to claim 1, wherein a coat by post-coating is formed on the chamfered part along irregular convexoconcaves.

11. The projected corner column according to claim 10, wherein the coat by post-coating follows the width of the irregular convexoconcaves formed on the chamfered part.

12. The projected corner column according to claim 10, wherein the coat by post-coating slightly reaches the board piece beyond the boundary between the chamfered part and the board piece.

13. The projected corner column according to claim 12, wherein the lower edge of the coat by post-coating is approximately linear when the projected corner column is seen laterally.

14. The projected corner column according to claim 10, wherein the coat by post-coating consists of at least two coat layers.

15. The projected corner column according to claim 4, wherein plain view shapes of the parts corresponding to the convex regions of the embossed pattern are different from each other at least at adjacent convex regions in the narrow chamfered part.

16. The projected corner column according to claim 3, wherein two board pieces are bonded by using a moisture-curable adhesive.

17. The projected corner column according to claim 4, wherein two board pieces are bonded by using a moisture-curable adhesive.

* * * * *